United States Patent [19]

Beiswenger et al.

[11] 4,442,977

[45] Apr. 17, 1984

[54] AIRLESS ELECTRIC SPRAYER

[75] Inventors: John L. Beiswenger, Grayslake; Frank A. Smiesko, McHenry; Dhananjay V. Chaphalkar, Lindenhurst, all of Ill.

[73] Assignee: Acme Burgess, Inc., Grayslake, Ill.

[21] Appl. No.: 342,262

[22] Filed: Jan. 25, 1982

[51] Int. Cl.[3] ..... B05B 9/04

[52] U.S. Cl. ..... 239/332; 239/333

[58] Field of Search ..... 239/332, 333, 350, 302, 239/600; 222/333

[56] References Cited

U.S. PATENT DOCUMENTS

| | | | |
|---|---|---|---|
| 3,120,347 | 2/1964 | Duke, Jr. | 239/332 |
| 3,899,134 | 8/1975 | Wagner | 239/332 |
| 3,993,250 | 11/1976 | Shure | 239/332 |
| 4,162,037 | 7/1979 | Koyama | 239/332 |

*Primary Examiner*—John J. Love

*Assistant Examiner*—Paul A. Sobel

*Attorney, Agent, or Firm*—Howard H. Darbo

[57] ABSTRACT

An improved airless electric sprayer is disclosed having superior balance, portability, receptacle interchangeability, cleanability and a non-tipping stand feature. The user's hand conveniently grasps a piston grip in close proximity to the nozzle for accurate spray control at a position generally above the combined center of mass of a motor housing and receptacle for balanced comfortable use. The invention includes a release and lock arrangement affording handy receptacle attachment and disengagement without need for unscrewing the receptacle from the body of the sprayer, which also prevents spillage. To prevent clogging, any unsprayed liquid is allowed to accumulate around a reduced piston section and drain therefrom back into the receptacle. The housing has an access panel to expose pump assembly for convenient cleaning.

11 Claims, 17 Drawing Figures

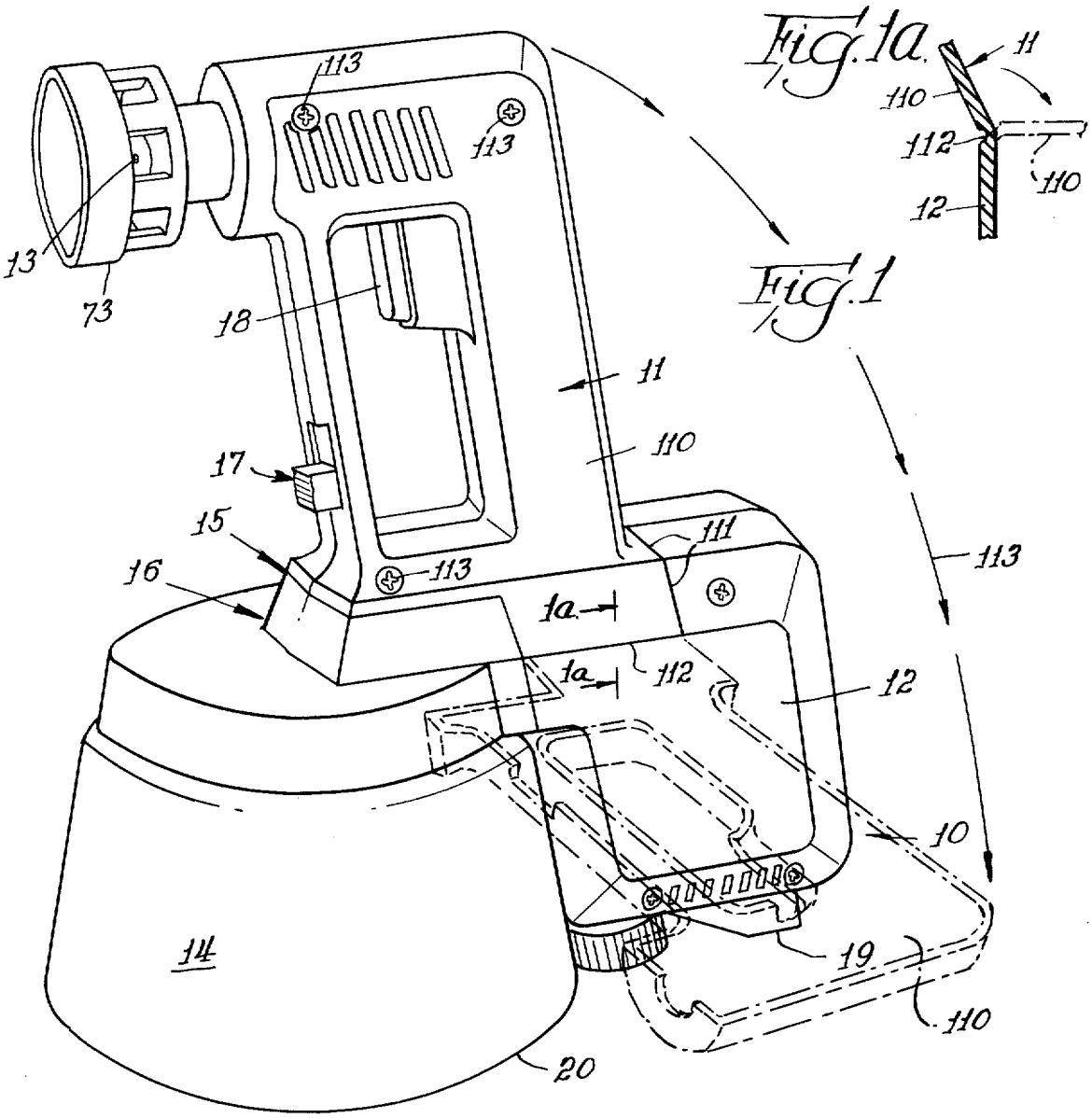
Fig. 1a.
11
110
112
110
12
Fig. 1
113
113
13
73
18
11
110
17
15
16
113
111
113
1a
1a
112
12
10
14
19
110
20
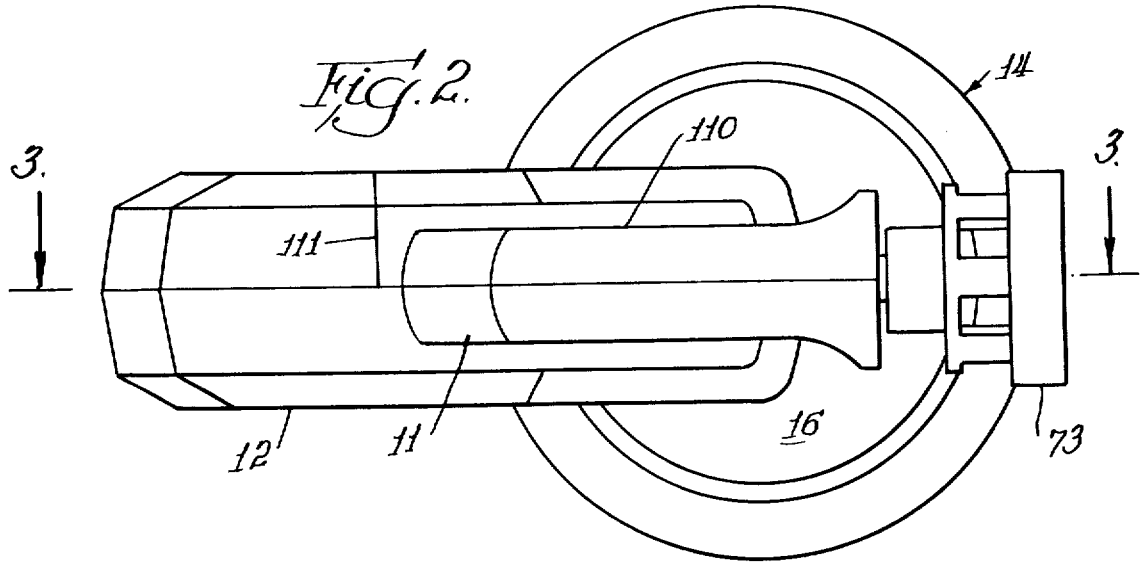
Fig. 2.
14
110
3.
3.
111
12
11
16
73

Fig. 4.
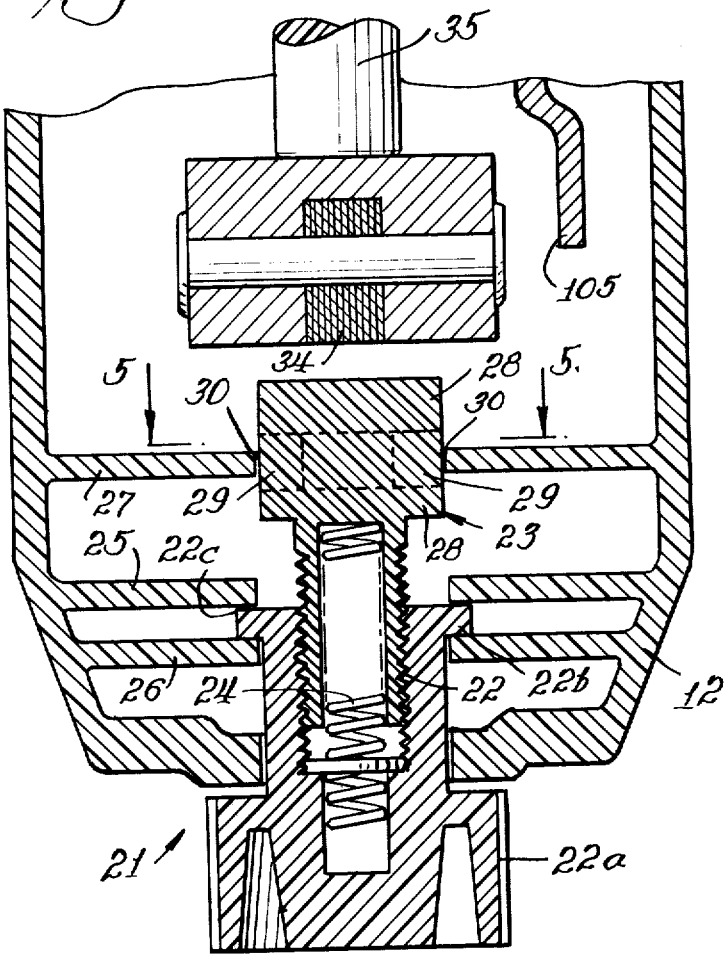
Fig. 5.
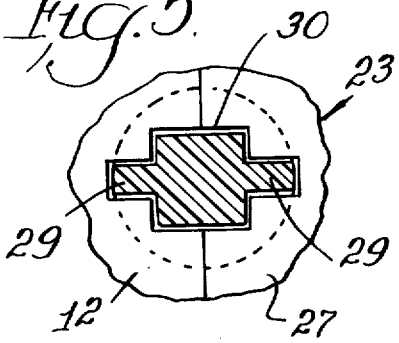
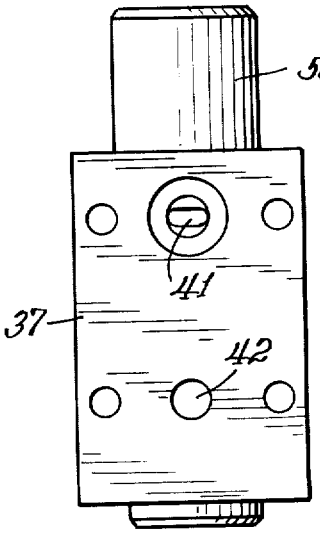
Fig. 7
Fig. 9.
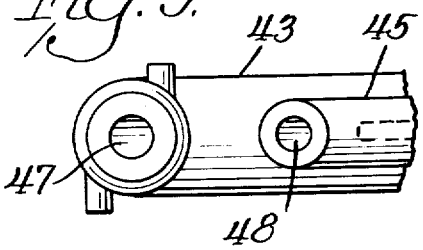
Fig. 8
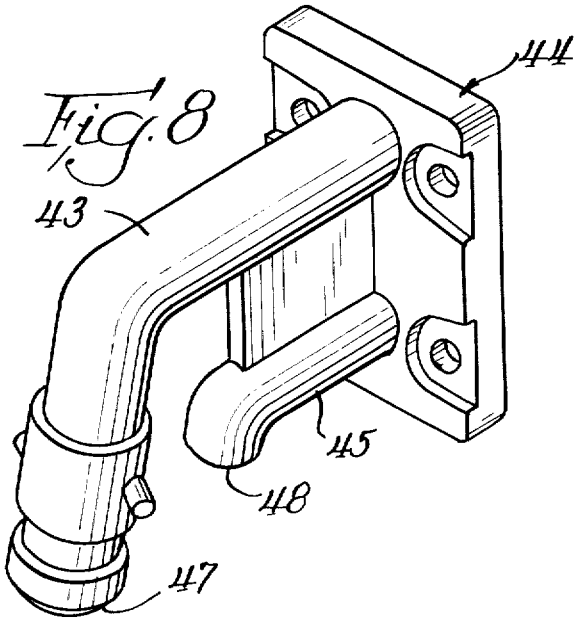

63
59
55
54
53
56
57
58
52
37
108
105
83
113
43
44
41
40
106
108
46
45a
45
42
36
107
47a
48
47
38
33
10.
49
10.
35
34a
51
50

50
49
51

63
113
113
18
66
65
69
67
70
71
64
68
72
74
75
76
73
81
80
78
13
79
77
12.
12.
13.
13.
13
74
72
73
81
80
80
81
78
79
78
77

AIRLESS ELECTRIC SPRAYER

BACKGROUND AND SUMMARY OF THE INVENTION

Most airless electric sprayers locate the relatively heavy electric motor above the paint receptacle or even above the sprayer handle and thus the user's hand. At these locations the heaviness of the magnet and stator gives a wobbly feel to the sprayer when held in spraying position. Moreover, in such sprayers, the handle is located back of the paint receptacle and the motor which requires the user to counterbalance the combined masses with his wrist. This is uncomfortable and tiring to a user attempting to apply paint in a workmanlike manner. For comfortable balance, it has been discovered that an improved airless electric sprayer could be obtained by arranging for the paint receptacle and the motor to counterbalance each other so that the user need only apply a supportive vertical force for the entire unit. It has also been learned that placement of the paint receptacle and the magnet and stator comprising the motor below the hand significantly improves balance for ease of operation. This problem has been efficiently solved in the disclosed improved sprayer.

In further attaining ease of use of an electric sprayer, the invention further provides for the quick release and reattachment of the paint receptacle with its specially formed closure to the sprayer housing. The receptacle need not be unscrewed from the housing but by a simple action of the user the receptacle with its closure may be quickly removed from the housing. This prevents spillage and also allows for interchangeability from a paint receptacle to a receptacle containing paint thinner or similar solvent to clean the sprayer and then to a different paint.

During the course of spraying, quite frequently the user wants to put the entire unit down to survey his accomplishments or temporarily halt operation for some other reason. In providing solutions to many of the problems encountered in spraying, the invention further provides a built-in non-tipping stand or placement feature by which the sprayer unit is supported upon a flat surface by not only the bottom rim of the receptacle but also by a foot extending downwardly from the motor housing integrally therewith. With this positive standing ability, the likelihood of tipping is minimized.

Airless electric sprayers may become clogged due to paint seepage back along the piston inside the cylinder. A few sprayers provide a drain communicating with the piston cylinder located at a position such that when the piston takes an intake stroke it moves past the drain port, opening the cylinder to the drain for return to the receptacle of unspent paint. Such residual paint can nonetheless still move backward along the piston possibly entering parts of the mechanism and causing clogging or sticking problems.

Frequent and thorough cleaning of the entire pump and liquid delivery mechanism ensures operability of the sprayer for each new job. An access panel is provided in the housing to expose the pump assembly and the structure is otherwise designed for convenient cleaning.

A further benefit to the user provided by the improved sprayer comprises a specially formed piston having a reduced diameter central portion which advantageously allows the drain port to open along the length of the piston where unused paint may accumulate for direct return to the receptacle without necessitating piston travel beyond the drain.

The invention further allows the user to not only comfortably hold the sprayer but also to grasp it in close proximity behind the nozzle, almost as if it were an extension of the index finger, for accurate control over the direction of the spray emission.

BRIEF DESCRIPTION OF THE DRAWING

FIG. 1 is a perspective view of the improved airless electric sprayer embodying the best mode of the invention including in phantom lines the access panel in open position.

FIG. 1*a* is a detail of the access panel hinge shown in cross section taken at line 1*a*—1*a* of FIG. 1.

FIG. 2 is a top view of the sprayer shown in FIG. 1.

FIG. 4 is a cross-sectional view taken at line 4—4 of FIG. 3 showing the piston stroke adjustment means.

FIG. 5 is a cross-sectional view taken at line 5—5 of FIG. 4 showing the limit stop for intake piston travel.

FIG. 7 is a front view of the pump cylinder body in a mode best exemplifying the invention.

FIG. 8 is a perspective view of the siphon fitting adapted for cooperation with the pump cylinder body shown in FIG. 7.

FIG. 9 is a bottom view of the siphon fitting shown in FIG. 8.

DESCRIPTION OF EXAMPLE EMBODYING BEST MODE OF THE INVENTION

Figure 3:
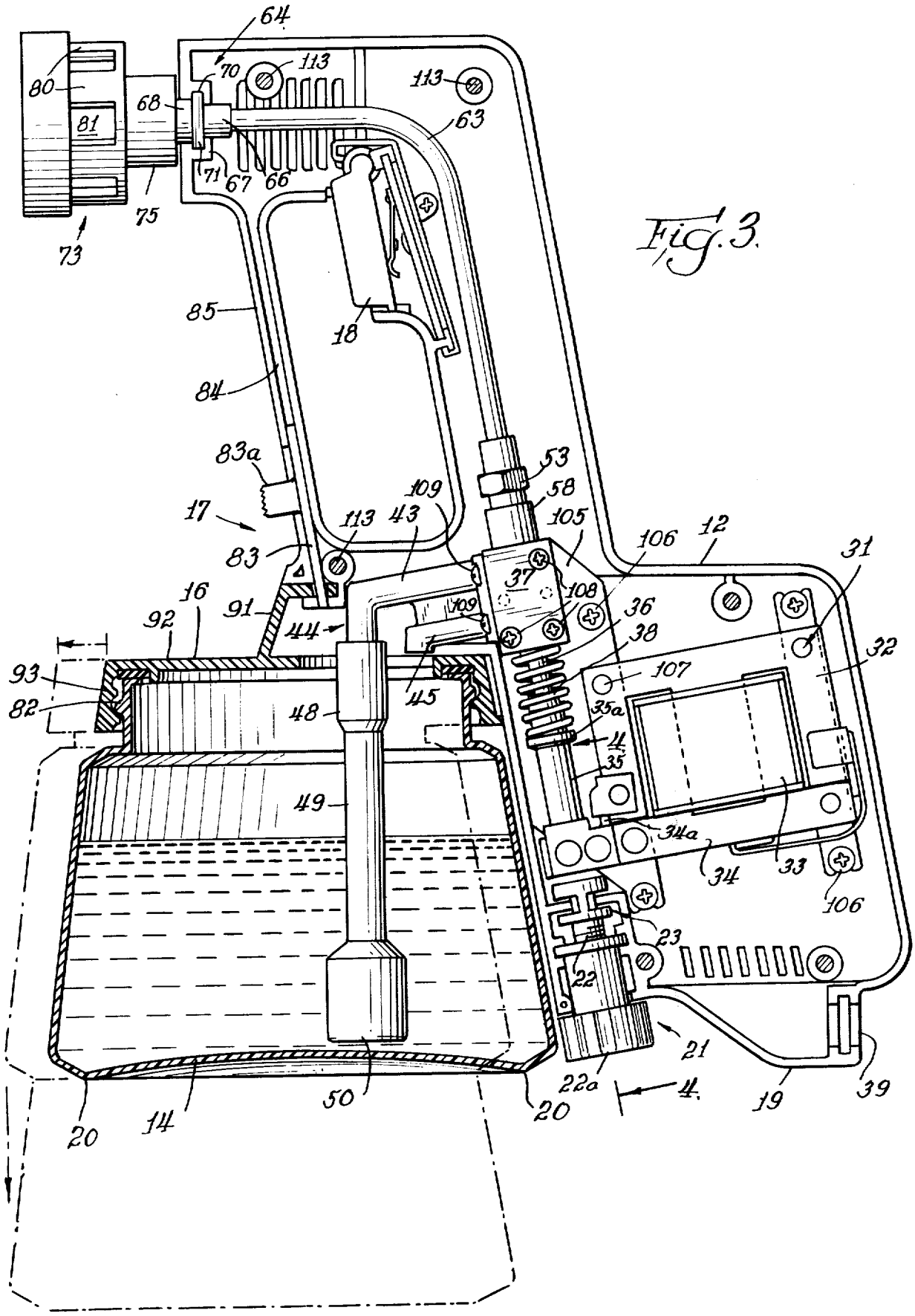
FIG. 3 is a cross-sectional view taken at line 3—3 of FIG. 2 with the receptacle shown disengaged in phantom lines.
Figures 6, 10:
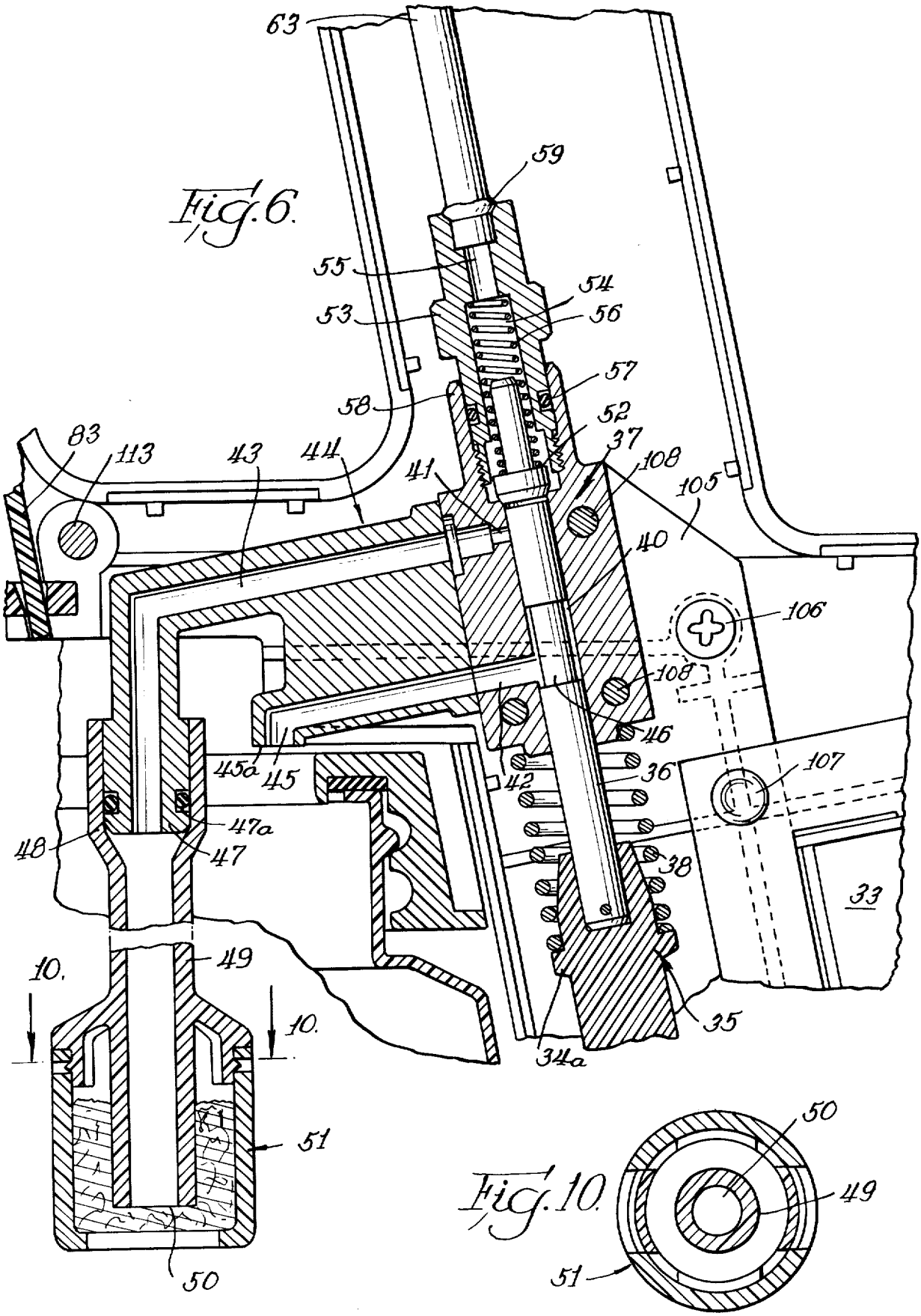
FIG. 6 is a detail view in cross section of a portion of the preferred embodiment taken along a vertical bisecting plane.
FIG. 10 is a cross-sectional view taken along line 10—10 of FIG. 6, showing the siphon tube and strainer arrangement.

FIG. 1 is a perspective view of the improved sprayer of the invention. Sprayer 10 is shown having the unique formation for and location of pistol grip 11 with respect to integral motor housing 12 which allows the user's hand to be in close proximity to nozzle 13 for the accurate application of paint to a surface. The convenient quick release and lock for the paint jar or receptacle 14 is shown in attached and locked position at locking assembly 15. A receptacle closure 16, complementary with a lock means 17 of the pistol grip, affords the user easy and quick changing of receptacle or attachment and detachment of a similar receptacle. Trigger assembly 18 is advantageously placed near the top of pistol grip 11 for operation by the index finger of the operator. The location of the pistol grip requires disposition of the user's hand generally above the combined centers of mass of the motor within housing 12 and of receptacle 14 and its contents. Not only is the user's hand in position for accurate spraying but comfortably supports the sprayer above these two counterbalancing lower elements so that there is minimal rotational moment which would tire the wrist. The weights of these two relatively heavy parts of the sprayer hang below the user's hand avoiding any wobbly feeling of the sprayer during use. Motor housing 12 terminates at its lowermost portion in foot 19, the bottom surface of which is co-planar with the bottom rim 20 of receptacle 14. Thus, sprayer 10 may be placed on a reasonably flat and horizontal surface without fear of tipping.

Sprayer 10 is adapted for use with typical paint sprayed in airless electric sprayers and is especially designed to handle the more difficulty sprayed water base paints. The invention allows the user to interchange a receptacle 14 containing paint and a different receptacle containing a solvent for cleaning the sprayer quickly and easily without the necessity of unscrewing the receptacle from the sprayer housing as is typical in conventional sprayers.

The sprayer housing of this invention is symmetrical about a bisecting plane as indicated in FIG. 2 along line 3—3. This symmetry along with the position of the user's hand at pistol grip 11 above motor housing 12 and receptacle 14 adds to the general comfort and efficiency of use of the sprayer.

The drawings illustrate at various sections and portions thereof several salient features of the invention which may be readily appreciated. An external adjustment means 21 is provided for adjusting the functioning location of the piston. An external adjustment knob **22*a* is connected through screw threads 22 with a limit stop 23 being resiliently urged apart by a compression spring 24 carried within hollow central portions thereof, the only purpose being to maintain friction between engaging threads and thus retain a particular adjustment setting. External adjustment means 21 controls the length of stroke of the pump piston for occasional spray adjustment when necessary. Stop 34*a*** limits forward piston travel.

The mounting of adjustment knob **22*a* within the sprayer housing structure is such that it is rotatable but retained against axial movement by a peripheral flange 22*b* which is integral with knob 22*a* and seated within a circular groove 22*c* defined by fixed flanges 25 and 26 which are fixed and integral with the housing (FIG. 4). Stop 23 is held against rotation but free to move axially responsive to rotation of adjusting knob 22*a*. Arms 29 extend into complementarily-shaped notches 30 in flange 27 of motor housing 12. Flanges 28 of stop 23 overlap fixed flange 27 and limit the extent of axial travel of stop 23 to the distance between the confronting surfaces of flanges 28**.

The sprayer includes a conventional electric oscillating motor 31 having a stator 32 and electromagnet 33. An armature 34 associates with stator 32 and electromagnet 33 in pivoting relationship and is connected to pump piston 36 through a connecting rod 35, preferably composed of plastic such as nylon to drive the piston in known manner. Compression spring 38 held between circular flange **35*a* and pump housing 37**, continuously biases the piston downwardly to power the return stroke thereof.

Adjacent external adjustment means 21 is a specially formed foot 19 of motor housing 12 which is generally co-planar with rim 20 of receptacle 14 to afford the non-tipping end feature of the invention. Electrical connection with motor 31 is obtained by an opening 39 in the foot 19 for passage of electric wires to the motor. This positioning places the electric cord for the invention at a convenient distance from the hand-held position at trigger 18 of pistol grip 11 and in this location continues the balanced symmetry which the invention achieves.

Pumping of paint or other liquid from receptacle 14 takes place within pump housing 37. Piston 36 reciprocates within cylinder 40 in pump housing 37. Siphon port 41 opens into cylinder 40 and connects with a siphon passageway 43 of siphon fitting 44. Drain port 42 opens into cylinder 40 below port 41 and connects with drain passageway 45 of siphon fitting 44. Drain 42 opens into a portion of cylinder 40 through which a reduced diameter segment 46 of piston 36 passes for purposes that will be shortly explained.

Receptacle 14 is mounted in the sprayer unit and closed by means of a specially formed closure 16 having an opening 100 therein through which siphon fitting 44 extends and siphon passageway 43 and drain passageway 45 open into receptacle 14, the former by means of siphon tube 49. Siphon passageway 43 terminates at end 47 and drain passageway 45 terminates at end **45*a*. End 47 snuggly fits within collar 48 of tube 49. An O-ring 47*a* is provided to seal the connection. Tube 49 is of a length to dispose lower open end 50 adjacent the bottom of receptacle 14 with a strainer cage 51 coupled therearound. As a vacuum is created in cylinder 40 during the back stroke of piston 36, paint or other material to be sprayed is drawn upward from open end 50 through siphon port 41 and into cylinder 40**.

As liquid is siphoned into cylinder 40 the pump stroke quickly follows and paint is forced through check valve 52. Check valve 52 is forced open for entry into check valve housing 53 for passage into chamber 54 and then passageway 55. A compression spring 56 continuously biases check valve 52 toward closed position. Check valve housing 53 is screwed into snout 58 of pump housing 37, an O-ring 57 being provided to ensure a sealed joint. Delivery tube 63 is permanently connected at 59 with check valve housing 53 and leads to nozzle assembly 64.

With reciprocating movement of piston 36 within cylinder 40, a small amount of paint may pass downwardly between the piston and the cylinder. The reduced diameter section 46 of piston 36 allows for accumulation of such by-pass paint and permits drainage from the cylinder through drain port 32 and return to receptacle 14. Such prompt drainage of by-passed paint aids in preventing clogging or sticking of the moving mechanism and minimizes the need for cleaning or replacement of parts.

Figures 11, 12, 13:
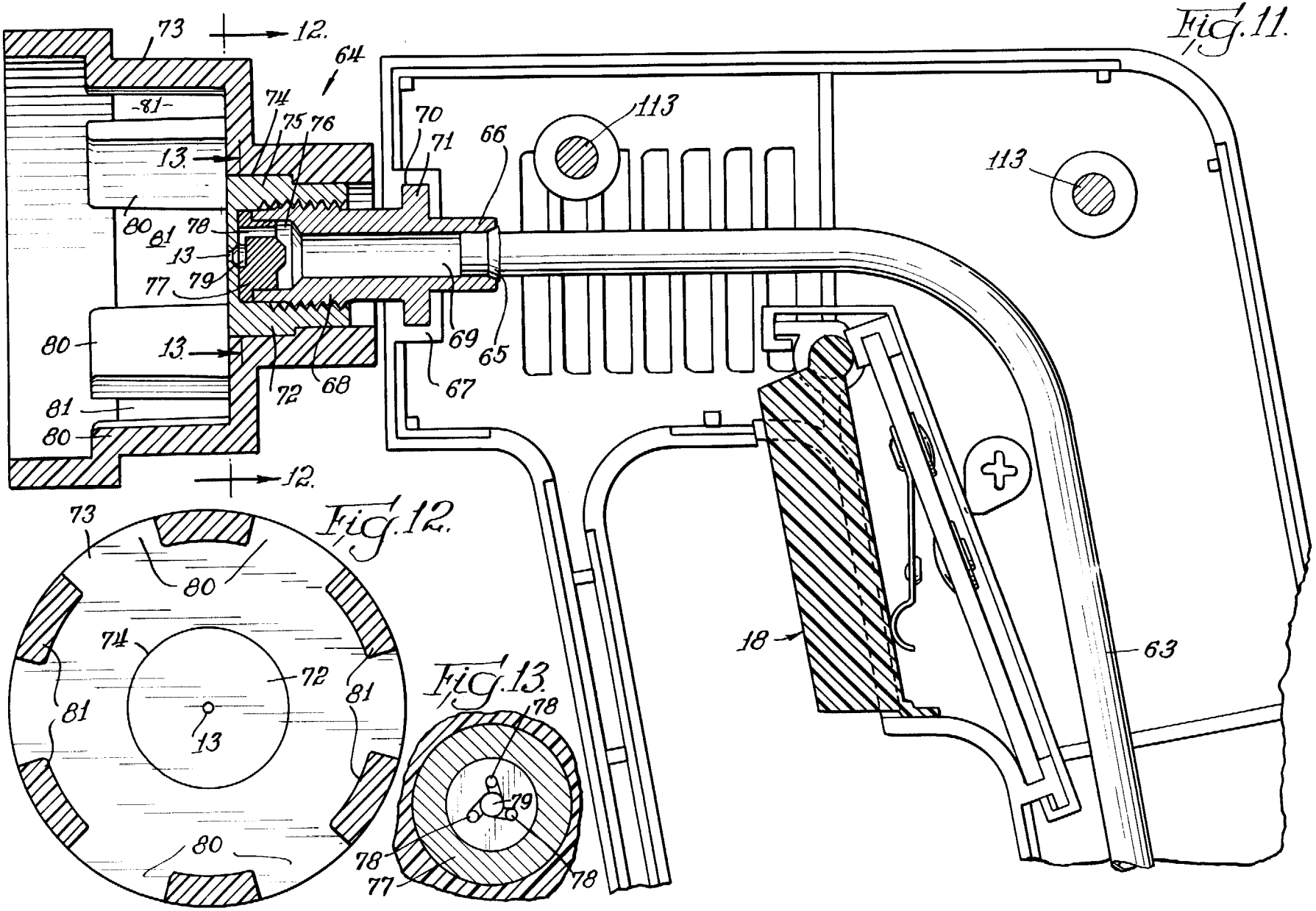
FIG. 11 is a cross-sectional view taken along a bisecting plane of the sprayer housing showing the pistol grip and the portion of the housing adjacent the nozzle.
FIG. 12 is a cross-sectional view taken along line 12—12 of FIG. 11 showing the nozzle assembly.
FIG. 13 is a cross-sectional view taken along line 13—13 of FIG. 11 showing an interior section of the nozzle.

Referring especially to FIG. 11, nozzle assembly 64 atomizes the fluid from delivery tube 63 and forms it into a spray pattern. Delivery tube 63 is permanently secured to snout 66 of nozzle body 68. Pumped fluid passes through nozzle chamber 69 from tube 63. Nozzle body 68 is seated within recess 70 defined by fixed housing structure 67 by means of an integral mounting flange 71 which extends around nozzle body 68 and has a preferably square shape mating with a corresponding shape of recess 70. Fitting within recess 70 prevents it from rotating as nozzle fitting 72 is screwed onto it. In the embodiment disclosed, a nozzle guard 73 is force fit upon nozzle fitting 72 the enlarged annular portion 75 of which is nested in the space provided by bore 74.

Within nozzle assembly 64, chamber 69 opens into an enlarged throat portion 76. To achieve atomization of the liquid, atomizer means 77 is interposed between throat 76 and nozzle orifice 13. In the embodiment disclosed, atomizer 77 provides three spiral passages 78 (FIG. 13) accepting fluid flow from throat 76. As fluid under pressure flows through the plural passages 78, the liquid is atomized and flows in dispersed state through collector port 79 and is emitted as a spray through orifice 13. Spray emitted therethrough travels at a very high velocity and the nozzle body 73 extends forwardly from nozzle 13 a distance sufficient to protect against impact of the spray streams with the hands on any other part of the body of the user of the sprayer.

Other well-known atomizing means may be incorporated within the spirit and scope of the invention to achieve the desired atomized spray. Nozzle guard 73 may be provided with spaced apart posts 80 providing openings 81 therebetween for the free flow of air to be entrained with the atomized liquid spray.

A feature of the invention resides in the structural design that permits convenient thorough cleaning of the pumping mechanism and the replacement of parts as this may become necessary. The entire functional assembly is mounted in the housing half as illustrated in FIG. 3 by means of a mounting plate 105 which is secured to the housing by screws 106. The motor is mounted by means of stator 34 to plate 105 by means of rivets 107. Pump housing 37 is secured to the mounting plate by means of screws 108 and siphon fitting 44 is fastened to the pump housing, in turn, by screws 109.

A feature of the invention resides in the replaceability of pump housing 37. Since some sprayable materials, e.g., latex paint, contain abrasives which tend to wear internal working parts, instead of discarding the sprayer unit and purchasing a new one when such wear has rendered the sprayer essentially inoperable, the pump housing 37 and, if necessary, piston 36 may be easily removed and replaced with new components. In addition to the mounting means of the several component parts of the mechanism as described, an access panel 110 (see FIG. 1) is specially provided for access to the pump assembly for replacement of component parts and cleaning of the assembly. The pistol grip 11 upper portion of one half of the sprayer housing is separated from motor housing 12 along line 111 and a living hinge is provided at 112 so that when screws 113 are loosened and removed, the access panel may be drawn outwardly and downwardly as indicated by arrows 113 to expose the portion of the internal mechanism that may require cleaning or replacement of parts. With the removal of screws 108 the entire liquid flow assembly may be lifted out from the housing half and piston 36 and spring 38 may then be removed. Check valve assembly 53 may be unscrewed from snout 58 of the pump housing 37, releasing the check valve assembly for cleaning. After cleaning of all parts and replacement of those components that require it the entire mechanism may be reassembled and remounted in the housing and the access panel closed to complete the maintenance operations.

The quick release and lock means 17 for securing the paint receptacle to the sprayer housing may be described with reference to FIGS. 3 and 14–16 of the drawings. The receptacle closure 16 comprises a lid portion 92 and internally threaded rim skirt 93. The lid has a hole 100 for access to the interior of the receptacle. As an integral part of the closure, a superstructure **92*a* is provided at the location of the hole in the lid and is open at its top for access to the hole. Sidewalls 91 rise from the surface of the lid and their top edges 94 define a plane parallel with lid 92. A canopy 87 extends inwardly in plane 94 to an inner edge 86 and is provided with a slot 90 for the reception of lock bolt 83** when the closure is to be secured to the sprayer housing.

A pair of shelves 95 extend inwardly toward each other at the forward portion of the open top of superstructure **92*a*. The top surfaces of these shelves are coplanar with the top surface of canopy 87 and the thicknesses of the shelves and canopy are equal so that the undersurfaces are also coplanar. Thus, the shelves can slide into the space between flange 101 and shoulder 89 and canopy 87 can slide into the space between bracket 88 and shoulder 89 of the housing structure for supporting the closure 16 and hence receptacle 14 in operating position in the housing. If desired, notches 102 in the top surfaces of shelves 95 and detents 103 in the undersurface of shoulder 89 may be provided for ensuring full penetration of the closure to locking position pending manipulation of lock bolt 83 to pass through slot 90 and a slot 104 which is provided in bracket 88 in alignment with slot 90** when the closure is in sprayer operating position.

The sequence of steps for placing and securing the receptacle in operating position in the sprayer structure and for disengaging and removing the receptacle are illustrated in FIGS. 3 and 14–16 of the drawings. While the sprayer is held by means of the pistol grip in upright position, the loaded receptacle with closure screwed tightly thereto is lifted upwardly as indicated by arrow "a", the siphon tube 49 passing through hole 100 to enter the receptacle during this movement. When surface 94 of superstructure **92*a* engages the undersurface of shoulder 89, the receptacle assembly is moved in the direction of arrow "b", shelves 95 and canopy 87 sliding into the spaces between shoulder 89 and flanges 101 and bracket 88. When the closure has been moved fully to securing and operating position, the receptacle assembly is locked in the sprayer housing by sliding bolt 83 down slide 84 through slots 90 and 104 by means of handle 83*a***.

Figure 14:
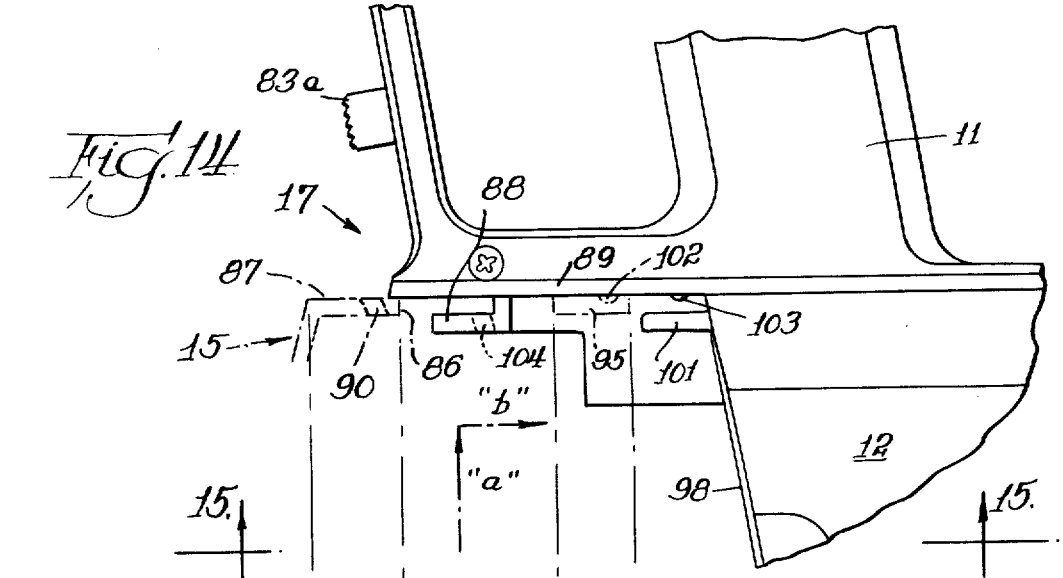
FIG. 14 is a vertically rotated side view of the preferred embodiment for the lock and release mechanism of the paint receptacle and showing, in phantom, the movement of the receptacle lid for engagement with the sprayer housing.
Figure 15:
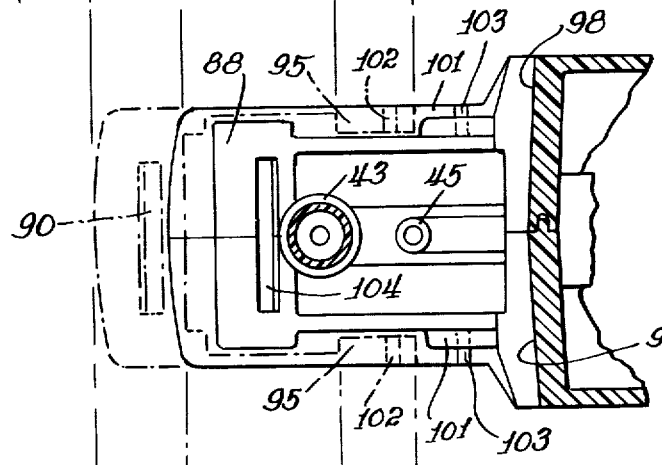
FIG. 15 is a bottom view of the lock and release mechanism taken at line 15—15 and shown in line with the view in FIG. 14 and including receptacle lid engagement in phantom.
Figure 16:
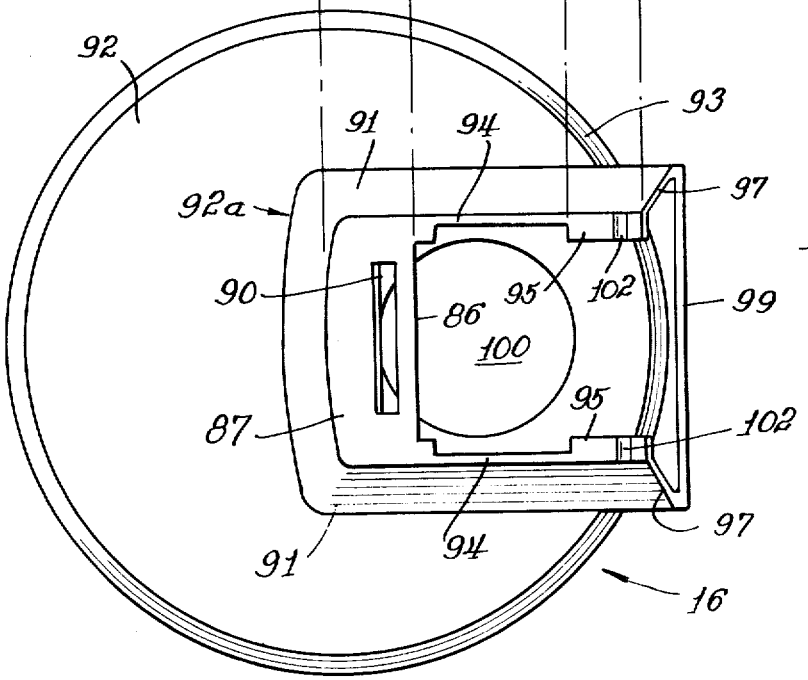
FIG. 16 is a top view of the lid for a receptacle shown in position, in line with FIG. 15, for locking engagement with the locking mechanism of the pistol grip portion of the sprayer housing.

The described horizontal movement into locking position is indicated in FIGS. 14–16, the positions of the parts at the beginning of the movement being shown in dot-dash lines and by solid lines, in FIG. 15, when in full locking position.

The inner edges 97 and 99 of superstructure sidewalls 91 are designed to conform with the surface 98 of housing structure to provide an abutting engagement.

Disengagement of closure 16 with attached receptacle 14 from the sprayer housing is accomplished by reversing the procedure and sliding lock bolt 83 upwardly, reversing movement "b" to position shelves 95 in a downwardly movable location between flanges 101 and bracket means 88 and moving canopy 87 in the same motion to clear bracket means 88 at the other side. Then movement "a" is reversed, the siphon tube structure being withdrawn from the receptacle. If desired, a receptacle and closure assembly can then be immediately inserted and secured in position for continuing the paint job or cleaning the sprayer.

ACHIEVEMENTS OF THE INVENTION

An airless electric sprayer is provided with improvements which significantly contribute to ease of spraying and improvement of the quality of the paint job. Weight balance and location of the grip enhance comfort and accuracy. A cylinder drain continuously removing piston by-pass paint significantly minimizes clogging. Sprayer maintenance, especially cleaning and replacement of worn component parts, is simplified by the provision of an access panel in the housing and by mechanism mounting means which make it possible to remove and replace the pump housing. The need for screwing and unscrewing paint receptacles in the sprayer housing, an awkward operation at best, has been eliminated by the provision of a unique lock and release means offering ease of engagement and removal of a receptacle closure assembly. Receptacles containing different liquids may be quickly interchanged and the danger of spilling is minimized.

With the user's hand above the paint receptacle and motor housing, tedious jobs become less burdensome and a workmanlike spray application is more easily attained.

We claim:

1. In an airless electric sprayer having a housing; a liquid flow assembly mounted within and fastened to said housing and including a pump, liquid siphon means connected to the inlet of said pump and spray nozzle means connected to the outlet of said pump; an electric motor mounted within said housing and operatively connected with said pump to drive the same; and receptacle means supported by said housing and into which said siphon means extends; the improvement wherein said receptacle means comprises a receptacle having an open top and a closure therefor, said closure being a part separate from and including no part of said housing or other sprayer structure, said closure comprising means for closing attachment to said top of said receptacle, said closure and said housing having respectively interacting means for supporting said receptacle means from said housing in detachably locked engagement therewith, said interacting means comprising a lid portion on said closure, said lid portion having a hole therein, and said closure having a superstructure integral with said closure and above said hole, said superstructure having sidewalls and an open top, and a horizontal canopy and horizontal side shelves coplanar with said canopy extending inwardly from the top edges of said sidewalls, said interacting means further comprising, as a part of said housing, bracket and shoulder structures defining spaces into which said canopy and side shelves can horizontally slide to support said closure in said housing, said receptacle means being separately removable from said housing.

2. Structure in accordance with claim 1 wherein said canopy and said bracket structure have slots therein which are in alignment when said closure is in support position in said housing, said housing having structure forming a generally vertical slide therein aligned with said slots and a lock bolt arranged within said slide for retractable movement into said slots to lock said closure in position.

3. Structure in accordance with claim 1 wherein said siphon means extends from said pump through said hole in said lid portion of said closure substantially to the bottom of said receptacle.

4. In an airless electric sprayer having a housing; a liquid flow assembly mounted within and fastened to said housing and including a pump, liquid siphon means connected to the inlet of said pump and spray nozzle means connected to the outlet of said pump; an electric motor mounted within said housing and operatively connected with said pump to drive the same; and receptacle means supported by said housing and into which said siphon means extends; the improvement wherein said receptacle means comprises a receptacle having an open top and a closure therefor, said closure being a part separate from and including no part of said housing or other sprayer structure, said closure comprising means for closing attachment to said top of said receptacle, said closure and said housing having respectively interacting means for supporting said receptacle means from said housing in detachably locked engagement therewith, said receptacle means being separately removable from said housing, and wherein the upper portion of said housing forms a pistol grip and said spray nozzle means includes a spray nozzle supported at the top of said pistol grip, said receptacle means being located below and rearwardly of said pistol grip whereby the respective weights of said receptacle and said motor generally balance each other with respect to said grip.

5. Structure in accordance with claim 4 wherein said receptacle means includes a receptacle having a substantially flat bottom and the portion of said housing remote from said receptacle and containing said motor includes a foot extending downward to the plane of said flat bottom.

6. Structure in accordance with claim 4 wherein said housing consists of two symmetrical side halves separably fastened together and said liquid flow assembly is mounted in the first of said housing halves, and wherein the upper portion of the second of said halves including said portion forming said pistol grip is hingedly attached to the lower portion of said second of said halves and otherwise separated therefrom to form an access panel separately detachable from said first of said halves to give convenient access to said liquid flow assembly and said pump.

7. Structure in accordance with claim 6 wherein said pump is removably mounted in said housing and spray nozzle means and said siphon means are both detachably connected to said pump and wherein said housing is provided with an access panel at the location of said pump whereby said pump is removable from said liquid flow assembly and from said housing for replacement of any component parts thereof.

8. In an airless sprayer having a housing; a liquid flow assembly mounted within and fastened to said housing and including a pump, liquid siphon means connected to the inlet of said pump and spray nozzle means connected to the outlet of said pump; an electric motor mounted within said housing and operatively connected with said pump to drive the same; and receptacle means supported by said housing and into which said siphon means extends; the improvement wherein said receptacle means comprises a receptacle having an open top and a closure therefor, said closure being a part separate from and including no part of said housing or other sprayer structure, said closure comprising means for closing attachment to said top of said receptacle, said closure and said housing having respectively interacting means for supporting said receptacle means from said housing in detachably locked engagement therewith, said receptacle means being separately removable from said housing, and wherein said pump is removably mounted is said housing and said spray nozzle means and said siphon means are both detachably connected to said pump and wherein said housing is provided with an access panel at the location of said pump whereby said pump is removable from said liquid flow assembly and from said housing for replacement of any component parts thereof.

9. In an airless electric sprayer having a housing; a liquid flow assembly mounted within said housing and including a pump, liquid siphon means connected to the inlet of said pump and spray nozzle means connected to the outlet of said pump; an electric motor mounted within said housing and operatively connected with said pump to drive the same; and receptacle means supported by said housing and into which said siphon means extends; the improvement wherein the upper portion of said housing forms a pistol grip and said spray nozzle means includes a spray nozzle supported at the top of said pistol grip, said receptacle means being located below and forwardly of said pistol grip and said motor being located below and rearwardly of said pistol grip whereby the respective weights of said receptacle and said motor generally balance each other with respect to said grip.

10. In an airless electric sprayer having a housing; a liquid flow assembly mounted within said housing and including a pump, liquid siphon means connected to the inlet of said pump and spray nozzle means connected to the outlet of said pump; an electric motor mounted within said housing and operatively connected with said pump to drive the same; and receptacle means supported by said housing and into which said siphon means extends; the improvement wherein said housing consists of two symmetrical side halves separably fastened together and said liquid flow assembly is mounted in the first of said housing halves, the upper portion of said housing forming a pistol grip and said spray nozzle means including a spray nozzle supported at the top of said pistol grip, the upper portion of the second of said halves including said portion forming said pistol grip being hingedly attached to the lower portion of said second of said halves and otherwise separated therefrom to form an access panel separately detachable from said first of said halves to give convenient access to said liquid flow assembly and said pump.

11. In an airless electric sprayer having a housing; a liquid flow assembly mounted within said housing and including a pump, liquid siphon means connected to the inlet of said pump and spray nozzle means connected to the outlet of said pump; an electric motor mounted within said housing and operatively connected with said pump to drive the same; and receptacle means supported by said housing and into which said siphon means extends; the improvement wherein said receptacle means comprises a receptacle having an open top and a closure therefor, said closure being a part separate from said housing and having means for closing attachment to said top of said receptacle, said closure and said housing having respectively interacting means for supporting said receptacle means in detachably locked engagement with said housing; a liquid flow assembly mounted within said housing and including a pump, liquid siphon means connected to the inlet of said pump and spray nozzle means connected to the outlet of said pump; an electric motor mounted within said housing and operatively connected with said pump to drive the same; and receptacle means supported by said housing and into which said siphon means extends; the improvement wherein said housing consists of two symmetrical side halves separably fastened together and said liquid flow assembly is mounted in the first of said housing halves, the upper portion of said housing forming a pistol grip and said spray nozzle means including a spray nozzle supported at the top of said pistol grip, the upper portion of the second of said halves including said portion forming said pistol grip being hingedly attached to the lower portion of said second of said halves and otherwise separated therefrom to form an access panel separately detachable from said first of said halves to give convenient access to said liquid flow assembly and said pump, said pump being removably mounted in said housing and spray nozzle means and said siphon means are both detachably connected to said pump whereby said pump is removable from said liquid flow assembly and from said housing for replacement of any component parts thereof.

* * * * *